United States Patent [19]

Landowski

[11] 4,016,859

[45] Apr. 12, 1977

[54] PRE-CAST FIREPLACE AND FLUE ASSEMBLY

[76] Inventor: Edmund A. Landowski, 1712 Spring St., Schofield, Wis. 54476

[22] Filed: Jan. 2, 1976

[21] Appl. No.: 645,973

[52] U.S. Cl. ..... 126/120

[51] Int. Cl.[2] ..... F24B 1/18

[58] Field of Search ..... 126/120

[56] References Cited

UNITED STATES PATENTS

| | | | |
|---|---|---|---|
| 1,069,944 | 8/1913 | Haggard | 126/120 |
| 2,691,291 | 10/1954 | Henderson | 126/120 UX |
| 3,721,225 | 3/1973 | Tidwell | 126/120 |

OTHER PUBLICATIONS

"Pre-Kast" Instant Fireplace Pamphlet, Rec'd in Office 8–28–64.

The Donley Book of Successful Fireplaces, Publ. by The Donley Brothers Co., 1947, 13900 Miles Ave., Cleveland, O. pp. 54–55.

*Primary Examiner*—Edgar W. Geoghegan
*Attorney, Agent, or Firm*—Henry C. Fuller

[57] ABSTRACT

A prefabricated fireplace and chimney stack assembly includes a preformed or pre-cast concrete fireplace stack which has intergrally molded therein a hearth, smoke chamber and chimney flue as well as a sub-mantle. A stack base includes one or more flues which can communicate with the flue passages in the fireplace stack and which can be provided with a clean-out door. A chimney stack extension is adapted to be supported on the top of the fireplace stack section and is provided with flues which register with the fireplace flue. The fireplace stack and the chimney stack extension are provided with scored sides having a simulated brick appearance. Other preformed parts include a fire clay insert which goes into the combustion chamber, a preformed mantle with simulated brick facing and two simulated brick columns or corner posts which together with the mantle surround the fireplace opening.

6 Claims, 2 Drawing Figures

16
50
20
40
24
22
18
102
100
26
29
88
92
27
2
126
136
128
134
162
12
160
112
10
16
120
28
40
41
42
72
30
34
18
32
46
44
62
70
102
100
80
83
66
54
82
84
26
64
27
91
88
2
56
94
136
122
124
134
58
60
68

14
96

PRE-CAST FIREPLACE AND FLUE ASSEMBLY

SUMMARY OF INVENTION

The invention provides a pre-cast concrete fireplace with preformed components which greatly reduce labor and material expense and facilitates quick assembly of a complete fireplace structure at the building site. The components include a pre-cast fireplace stack section having an integral hearth, smoke chamber and flue in which the stack can have a height of approximately 8 feet to span the distance between a ceiling and floor or basement supporting structure. A pre-cast stack base can be employed to support the fireplace section and has complementary flues to register with the flues in the fireplace stack for use with a furnace or a clean-out door connected to a flue in communication with an ash dump in the fireplace. A chimney extension is also provided with flues to register with the flues in the fireplace section and which is intended to extend above the roof line of the building. The back and sides of the chimney extension and the fireplace stack are scored to simulate brick.

The fireplace stack has an integrally molded sub-mantle or shelf which is adapted to receive a pre-cast mantle which also can be scored to simulate brick. Preformed columns cooperate with the mantle to fully enclose the fireplace entrance above the hearth. A fire clay insert also has scored sides, rear and bottom walls to simulate fire clay bricks in the combustion chamber.

Further objects, advantages and features of the invention will become apparent from the following disclosure.

DESCRIPTION OF PREFERRED EMBODIMENT

Figures 1, 2:
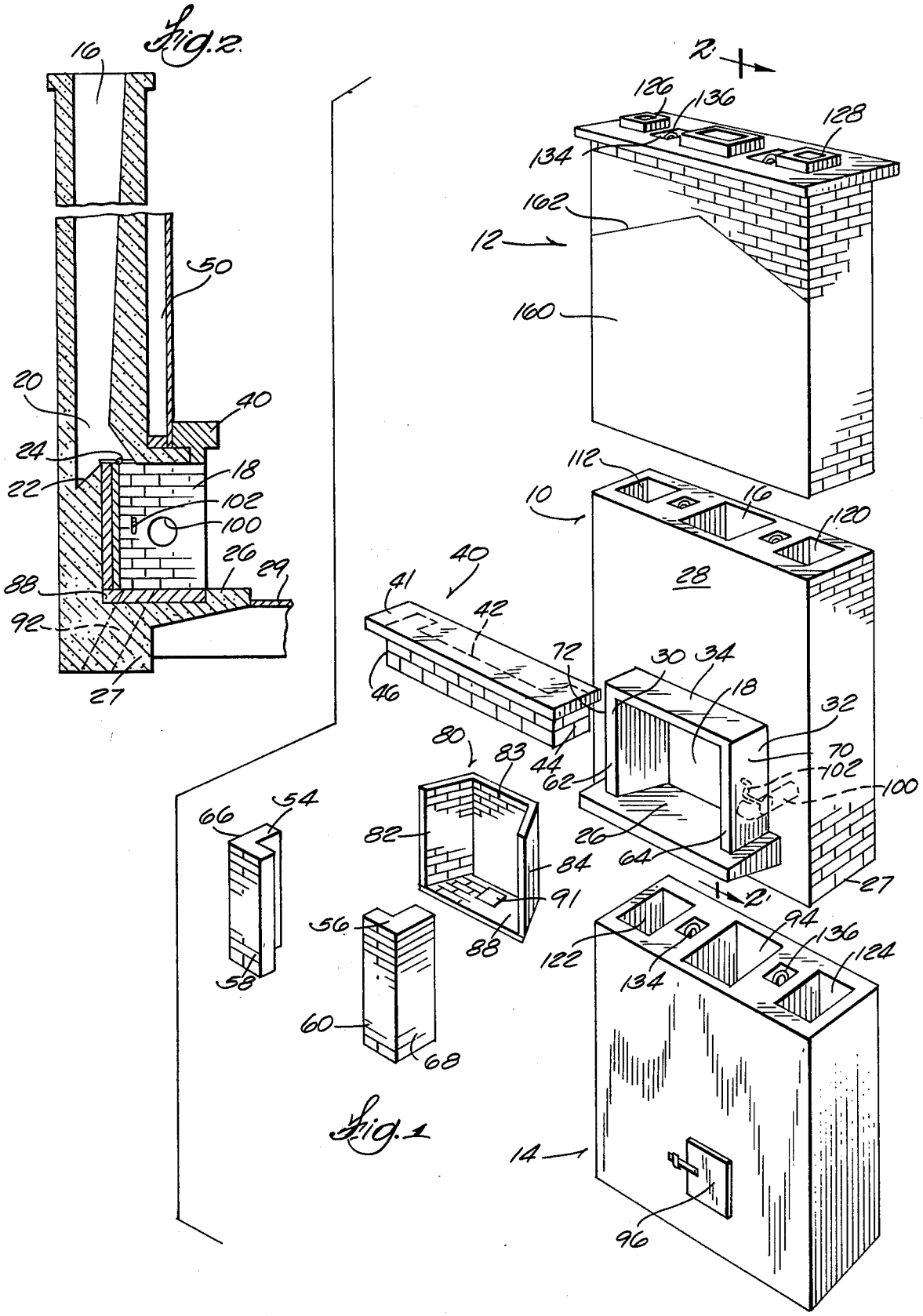
FIG. 1 is an exploded view of the various components of the preformed chimney, fireplace stack assembly of the invention.
FIG. 2 is an enlarged sectional view along line 2—2 of FIG. 1 of the fireplace stack section with the parts assembled.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

In the drawings, the basic components of the invention include the fireplace stack section 10, a chimney stack extension 12 and a base stack 14. The fireplace section 10, the chimney extension 12 and base 14 have the same general thickness and width, although the height can vary. These units 10, 12, 14 are each pre-cast from concrete and can be provided with various re-enforcing rods (not shown) to strengthen the concrete.

Referring more specifically to the fireplace stack section 10, section 10 is provided with walls defining a central flue 16 which communicates with the combustion chamber or opening 18 through a throat 20. An integrally formed smoke shelf 22 is also provided. A conventional damper 24 is installed subsequent to the molding of the unit 10. The stack 10 also includes a hearth 26 which projects forwardly of the face 28 of stack 10. The hearth 26 is located above the bottom 27 of the stack 10 so that the hearth will be at or above floor level 29 (FIG. 2) when supported by the base 14. Above the hearth are two integrally formed fireplace walls 30 and 32 which extend outwardly from the face 28 and merge with a horizontal sub-mantle or shelf 34.

The walls 30, 32 and 34 provide a form for alignment and support of the mantle 40 and two trim corner posts 54, 56. The mantle 40 is provided with a recess 42 which interfits with the shelf 34. The mantle top 41 is longer than the shelf 34 and the mantle portions 44 and 46 are located above the walls 30, 32 when the mantle is assembled on the shelf 34. As shown in FIG. 2, the depth of the recess 42 and the width of the shelf 34 are dimensioned to interfit with a stud wall 50 which may be located in front of the fireplace face 28.

The corner posts 54, 56 are formed from pre-cast angularly related wall portions with the wall portions 58, 60 extending over the wall edges 62, 64 of walls 30, 32. The side wall portions 66, 68 cover the side faces 70, 72 of the walls 30, 32. The corner posts and mantle can be scored to simulate brick. The fireplace is completed by a fireclay insert 80 which has angularly related walls 82, 83, 84 complementary to the angularly related inner surfaces of the combustion chamber. A base 88 can also be molded therein. All the walls and the base of the fireclay insert 80 can be appropriately scored to simulate fireclay bricks.

The fireplace can optionally be provided with an ash dump opening 91 in the insert 80 with a passage 92 in the stack 10 which can register and communicate with a passage 94 in the stack base 14. A clean-out door 96 can be located on the stack section 14.

The fireplace stack section 10 is also desirably provided with one or more passages 100 which are intended to communicate with the exterior of the building as a fresh air inlet for the fireplace. A valve or damper 102 can be provided to regulate air flow. Such an arrangement provides adequate oxygen and fresh air for the fire and minimizes drafts and loss of heat from the room in which the fireplace is located.

The stack section 10 as well as the other stacks are desirably provided with additional flues such as 112, 120 which substantially lighten the weight of the stack sections and which can be employed for venting the furnace, hot water heater, a basement fireplace and incinerator. The stack base 14 can be provided with flues 122 and 124 which register with flues 112, 120 and the chimney extension 12 can be provided with flues 126, 128 which also register with flues 112 and 120.

Each stack section is desirably provided with recesses 134, provided with loops 136 integrally molded in place to facilitate handling and assembling the stack sections. With the loops located in the recesses, there is no interference with the tops and bottoms of the stacks.

The fireplace stack 10 can be provided with simulated brick scoring on the rear and side faces, and the chimney extension can be provided with simulated brick scoring on all sides. As shown in FIG. 1, the scoring on the front 160 of the chimney extension is located above a simulated roof line 162.

I claim:

1. A preformed concrete fireplace comprising a chimney stack having a central flue, wall means defining a recess in said stack communicating with said flue, a hearth projecting outwardly from said stack section and above the bottom of the stack and said hearth together with said recess defining a combustion chamber including a ledge integrally formed with said stack section and projecting outwardly from said stack section above said hearth and wall means connecting said hearth with said ledge, said ledge forming a support for a mantle.

2. A preformed fireplace in accordance with claim 1 including a pre-cast mantle having a recess for receiving said ledge and preformed corner posts adapted to interfit with said first and second walls to enclose said walls and ledge together with said mantle.

3. A preformed fireplace in accordance with claim 1 including a fireclay insert having a central wall portion and two wing portions, said insert being adapted to be received in said combustion chamber.

4. A preformed fireplace in accordance with claim 1 wherein said chimney stack section has simulated brick scoring on the rear and side faces thereof.

5. A preformed fireplace in accordance with claim 1 including a chimney extension, said chimney extension having a flue adapted to register with said flue in said chimney stack, and wherein said extension is scored to simulate brick on three surfaces and partially scored on the fourth side face for a portion of its height to simulate brick above the roof line.

6. A preformed fireplace in accordance with claim 2 including a fresh air inlet passage extending through said stack section from exteriorly of the building into the combustion chamber.

* * * * *